US012752822B2

(12) United States Patent
Katzler et al.

(10) Patent No.: US 12,752,822 B2
(45) Date of Patent: Oct. 6, 2026

(54) MAGNETIC TRACK BRAKE HAVING A HIGH-POSITION DETECTING MEANS INSTALLED IN OR ON THE ACTUATION CYLINDER

(71) Applicant: KNORR-BREMSE GESELLSCHAFT MIT BESCHRÄNKTER HAFTUNG, Mödling (AT)

(72) Inventors: Dominik Katzler, Vienna (AT); Michael Kassan, Steinabrückl (AT); Daniel Tippelt, Wiener Neustadt (AT); Volker Joergl, Breitenfurt (AT)

(73) Assignee: KNORR-BREMSE GESELLSCHAFT MIT BESCHRÄNKTER HAFTUNG (AT)

( * ) Notice: Subject to any disclaimer, the term of this patent is extended or adjusted under 35 U.S.C. 154(b) by 490 days.

(21) Appl. No.: 18/281,488

(22) PCT Filed: Feb. 21, 2022

(86) PCT No.: PCT/EP2022/054178
§ 371 (c)(1),
(2) Date: Sep. 11, 2023

(87) PCT Pub. No.: WO2022/189127
PCT Pub. Date: Sep. 15, 2022

(65) Prior Publication Data

US 2024/0149926 A1 May 9, 2024

(30) Foreign Application Priority Data

Mar. 10, 2021 (DE) ..... 10 2021 001 273.9

(51) Int. Cl.
*B61H 7/08* (2006.01)

(52) U.S. Cl.
CPC ..... *B61H 7/086* (2013.01)

(58) Field of Classification Search
CPC ..... B61H 7/086; B60T 1/14; B60T 13/748; F16D 63/008; F16D 2121/20
See application file for complete search history.

(56) References Cited

U.S. PATENT DOCUMENTS 5,018,605 A * 5/1991 Hooghiem ..... B61H 7/086 188/165

FOREIGN PATENT DOCUMENTS

CN 105109515 A 12/2015
CN 209700684 U 11/2019
(Continued)

OTHER PUBLICATIONS

Translation of German Patent No. DE 19518893 obtained from PE2E database on Jan. 28, 2026.*
(Continued)

*Primary Examiner* — Pamela Rodriguez
(74) *Attorney, Agent, or Firm* — Barnes & Thornburg LLP

(57) ABSTRACT

A magnetic track braking device for a rail vehicle includes at least one pressure-medium-actuated actuation cylinder, which has a cylinder housing and an actuation piston movable relative to the cylinder housing, at least one magnet apparatus, which can be lowered into a low position onto a rail by the at least one actuation cylinder to generate, by a magnetic short circuit with the rail, a magnetic attractive force between the rail and the at least one magnet apparatus, and which can be placed, by the actuation cylinder, into a high position raised from the rail and into any intermediate positions between the low position and the high position; at least one high-position detecting apparatus, which generates a high-position signal when the high position is assumed by the at least one magnet apparatus.

16 Claims, 5 Drawing Sheets

(56) References Cited

FOREIGN PATENT DOCUMENTS

| | | | |
|---|---|---|---|
| DE | 19518893 | A1 | 8/1996 |
| DE | 202011050872 | U1 | 11/2012 |
| DE | 102012014158 | A1 | 1/2014 |
| DE | 202013103797 | U1 | 11/2014 |
| EP | 1145929 | A2 | 10/2001 |
| EP | 2951067 | B1 | 5/2018 |
| JP | H07196031 | A | 8/1995 |

OTHER PUBLICATIONS

Translation of German Patent No. DE 202013103797 obtained from PE2E database on Jan. 28, 2026.*
International Search Report corresponding to PCT/EP2022/054178 dated Jun. 27, 2022.

* cited by examiner

MAGNETIC TRACK BRAKE HAVING A HIGH-POSITION DETECTING MEANS INSTALLED IN OR ON THE ACTUATION CYLINDER

CROSS REFERENCE AND PRIORITY CLAIM

This patent application is a U.S. National Phase of International Patent Application No. PCT/EP2022/054178 filed Feb. 21, 2022, which claims priority to German Patent Application No. 10 2021 001 273.9, the disclosure of which being incorporated herein by reference in their entireties.

SUMMARY

Disclosed embodiments provide a magnetic track brake apparatus for a rail vehicle include at least one pressure-medium-actuated actuation cylinder which has a cylinder housing and an actuating piston movable relative to the cylinder housing; at least one magnet device which can be lowered into a low position onto a rail by the actuation cylinder in order to generate a magnetic attraction force between the rail and the at least one magnet device by a magnetic short circuit with the rail, and which can be placed, by the actuation cylinder, into a high position raised from the rail and into any intermediate positions between the low position and the high position; and at least one high-position detecting device which generates a high-position signal when the at least one magnet device assumes the high position.

BRIEF DESCRIPTION OF FIGURES

Disclosed embodiments are illustrated in the drawing and explained in more detail in the description which follows. In the drawings.

DETAILED DESCRIPTION

Figure 1:
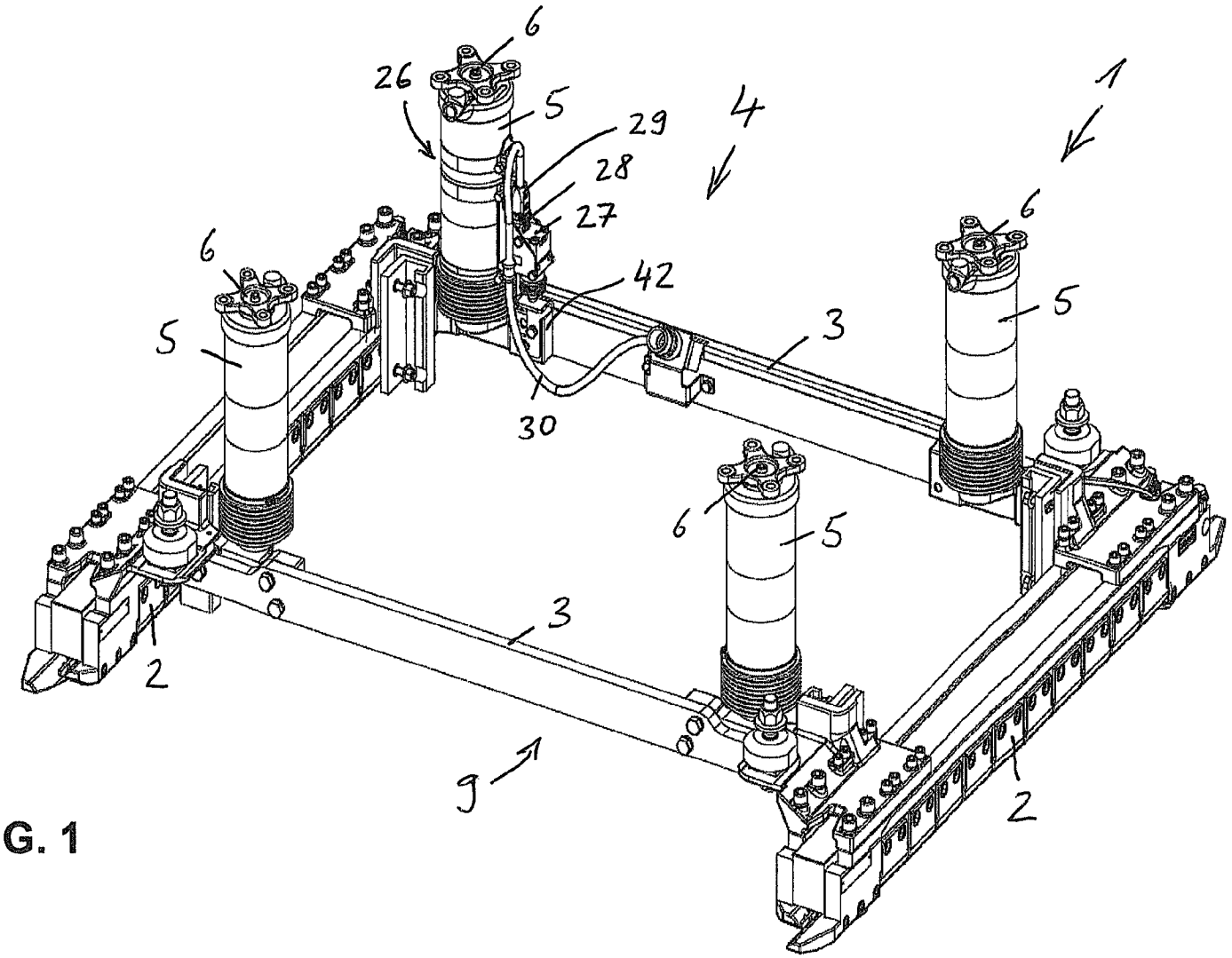
FIG. 1 shows a perspective illustration of a magnetic track brake apparatus according to a disclosed embodiment in a high position.

Disclosed embodiments provide a magnetic track brake apparatus for a rail vehicle include at least one pressure-medium-actuated actuation cylinder which has a cylinder housing and an actuating piston movable relative to the cylinder housing; at least one magnet device which can be lowered into a low position onto a rail by the actuation cylinder in order to generate a magnetic attraction force between the rail and the at least one magnet device by a magnetic short circuit with the rail, and which can be placed, by the actuation cylinder, into a high position raised from the rail and into any intermediate positions between the low position and the high position; and at least one high-position detecting device which generates a high-position signal when the at least one magnet device assumes the high position.

Optionally, the magnet device or magnetic track brake is attached to the bogie of the rail vehicle and for example has two linear articulated magnets which, in unactuated state, are arranged with parallel spacing above the two rails of a track section. To even out the braking effect and for mutual guidance of the two articulated magnets, these are coupled together via a brake frame which extends transversely over the width of the track section, so that the two articulated magnets and the brake frame form a rectangular frame shape. Each articulated magnet is actuated by two actuation cylinders lying one behind the other in the track longitudinal direction, the actuating pistons of which act on the articulated magnet and the actuation cylinder of which is flanged to the bogie. The actuating pistons are preloaded by spring tension upwards towards the bogie so that the articulated magnets are lifted away from the rail under the spring effect of the four actuating pistons. To lower the articulated magnets, compressed air for example is supplied to the working chambers of the actuation cylinders, whereby a compression force greater than the spring force is exerted on the actuating piston so that the actuating pistons are extended and the articulated magnets are brought into contact with the rail. At the same time, the articulated magnets are electromagnetically excited so that a braking force is built up by the resulting magnetic attraction force and the friction between the rail and the articulated magnets, and supports a braking force applied by the main brake system.

In the magnetic rail brake apparatus known from the prior art, also a high-position detecting device is present which generates a high-position signal when the at least one magnet device assumes the high position. The high-position signal, i.e. the signal which indicates that the magnet device has reached the high position, is evaluated in an electronic controller which (also) controls the actuation cylinders.

It is desirable here that the high-position detecting device is designed as a standardized unit which does not require project-specific adaptations to the bogie and magnetic track brake. Furthermore, the high-position detecting device should be largely insensitive to environmental influences and able to be mounted and removed easily.

Disclosed embodiments refine a magnetic track brake apparatus such that it can be used flexibly for a plurality of different magnetic track devices and is robust against environmental influences.

Both aspects of the disclosed embodiments are based on a magnetic track brake apparatus for a rail vehicle including at least one pressure-medium-actuated actuation cylinder which has a cylinder housing and an actuating piston movable relative to the cylinder housing; at least one magnet device which can be lowered into a low position onto a rail by the at least one actuation cylinder in order to generate a magnetic attraction force between the rail and the at least one magnet device by a magnetic short circuit with the rail, and which can be placed, by the actuation cylinder, into a high position raised from the rail and into any intermediate positions between the low position and the high position; and at least one high-position detecting device which generates a high-position signal when the at least one magnet device assumes the high position.

The magnet device may be formed by an articulated magnet or by a rigid magnet. The high-position signal, i.e. the signal which indicates that the magnet device has reached the high position, is for example evaluated in an electronic controller which (also) controls the at least one actuation cylinder.

According to disclosed embodiments, a high-position detecting device includes at least one electrical limit switch, configured e.g., as a microswitch, which is arranged inside the actuation cylinder and has at least two switch states, and which changes switch state when the magnet device assumes the high position.

Here, the electrical limit switch is integrated for example in an electrical circuit so that a change of switch state of the limit switch causes a change of signal level of the electrical circuit, which can then be evaluated by the electronic controller. On a change of its switch position, the limit switch may for example break the electrical circuit if it was previously closed, and vice versa.

Optionally, the electrical limit switch is designed and arranged such that, when the at least one magnet device is in the high position, it can be actuated directly or indirectly by the actuating piston.

Further, optionally, the high-position detecting device may comprise a structural unit which contains the limit switch, is releasably attached to or in a cover of the cylinder housing of the actuation cylinder and is arranged such that the limit switch protrudes into a working chamber of the actuation cylinder. The working chamber of the actuation cylinder can be loaded with pressure medium or relieved of pressure medium in order to actuate the actuating piston of the actuation cylinder. The structural unit may furthermore also comprise wiring which is connected to the limit switch and routed to the outside of the working chamber in order for example to transmit the signal generated by the limit switch to an electronic controller for evaluation. The limit switch may in particular be arranged between the cover and an end face of the actuating piston. Also, the structural unit may be arranged tightly on or in the cover of the actuation cylinder. The cover is for example also attached tightly to the actuation cylinder and for example closes a cylinder opening on an end face of the actuation cylinder.

The structural unit forms a high-position detecting module which can easily be mounted, namely merely by sealed insertion in the passage opening of the cover of the actuation cylinder, and removed by releasing the cover of the actuation cylinder. Preferably, the cover delimits a working chamber of the actuation cylinder which can be loaded with pressure medium and relieved of pressure medium and on the other end is delimited by the actuating piston, so that in an advantageous dual function, the cover firstly forms a fastening flange for the structural unit and secondly delimits the sealed working chamber of the actuation cylinder. Therefore the limit switch is arranged in the sealed working chamber of the actuation cylinder and hence protected from environmental influences.

According to a refinement, the limit switch may have a switch housing and an actuating element which, viewed in the usage position, is arranged on the outside of the switch housing and can be moved into an extended and a retracted position, wherein on movement of the actuating element between the extended position and the retracted position, the switch state of the limit switch changes. Furthermore, the actuating piston may have a central recess pointing towards the cover with a radially inner circumferential face, wherein the actuating element of the limit switch and the recess in the actuating piston are arranged and cooperate such that when the magnet device is in an intermediate position deviating from the high position, or in the low position, the actuating element of the limit switch is out of engagement with the radially inner circumferential face of the recess and then assumes the extended position, but when the magnet device is in or has reached the high position, the actuating element of the limit switch is in or comes into engagement with the radially inner circumferential face of the recess and is then pushed into the retracted position because of the contact. Here, the actuating element of the limit switch may be spring-pretensioned into the extended position.

Integration of the high-position detecting module or structural unit in the actuation cylinder according to the first aspect allows for example its attachment to the cover of the actuation cylinder. Because of the simple attachment method, the high-position detecting module can be rapidly removed from the magnetic track brake apparatus installed in the bogie. This substantially facilitates repair, service and maintenance. Because of the position of the high-position detecting module inside the actuation cylinder, protected from environmental conditions, no additional seals of the high-position detecting module are required. The resulting simple structure of the high-position detecting module consequently lowers production costs and facilitates repair and maintenance.

According to a further implementation of the disclosed embodiments, the high-position detecting device has a structural unit which is separate from the at least one actuation cylinder and is releasably attached to the cylinder housing of the at least one actuation cylinder by a fastening device, and at least one electrical limit switch which is arranged inside a housing of the high-position detecting device and has least two switch states, wherein the limit switch has an actuating element which can be placed into at least two different positions, and wherein, on movement of the actuating element between the at least two different positions, the switch state of the limit switch changes between the at least two switch states, and wherein the high-position detecting device has at least one actuator element which is movable on or in the housing such that the actuator element changes its position relative to the housing depending on the vertical position of the at least one magnet device, and hence exerts an influence on the position of the actuating element of the limit switch.

The actuator element is in particular a cylindrical body which, when the structural unit is mounted on the actuation cylinder, is arranged parallel to the actuation cylinder or actuating piston.

In particular, the structural unit of the high-position detecting device is attached to the actuation cylinder or to the outer surface of the cylinder housing exclusively and directly by the releasable fastening device. Also, the fastening device may be integrated in the structural unit or formed thereon. Furthermore, the structural unit of the high-position detecting device constitutes for example a structural unit which can be retrofitted on the actuation cylinder. Then the structural unit of the high-position detecting device can easily be mounted on pre-existing actuation cylinders.

The structural unit then for example constitutes a high-position detecting module which can easily be mounted, namely merely by releasable attachment to the outside of the actuation cylinder by the fastening device, and removed by releasing the fastening device from the actuation cylinder.

In other words, to detect the high position of the magnet device, optionally, a separate high-position detecting module is attached as a structural unit, optionally, the cylinder outer wall of the fastening cylinder, such that the actuator element, which is optionally configured as a plunger, after a specifiable travel, is pushed into the high-position detecting module for example by a stop element which is held on the brake frame and formed e.g., as a pressure plate. A limit switch arranged in the high-position detecting module is then actuated.

Optionally, the fastening device may comprise at least one clamping strap which is attached to the housing of the structural unit and which, viewed in the circumferential direction, at least partly clamps around the cylinder housing, wherein the clamping force can be adjusted for example, in particular by clamping screws. Accordingly, the structural unit is optionally held by friction on the cylinder housing by the clamping force of the at least one clamping strap, and can therefore easily be installed and removed.

Also, centering faces may be provided on the outer surface of the cylinder housing for centering the structural unit on the cylinder housing, and cooperate for example with complementary centering faces of the at least one clamping strap and/or the structural unit by form fit, so that the centering faces define a specific mounting position of the structural unit on the actuation cylinder. Alternatively, the structural unit may be attached on the actuation cylinder almost steplessly in relation to at least one rotational degree of freedom and/or one translational degree of freedom, in that the structural unit is fixedly clamped on the actuation cylinder in an assumed, defined position by the at least one clamping strap and held there by friction.

The magnetic track brake apparatus may also comprise a brake frame which has at least two magnet devices and two tie bars connecting the magnet devices transversely together, wherein the at least one actuation cylinder is attached on one side to the brake frame and on the other side to a bogie.

Here, the brake frame may have a stop element and the structural unit may be arranged on the at least one actuation cylinder such that the actuator element stops against the stop element, and thereby the position of the actuator element relative to the housing changes when the at least one magnet device reaches or has reached the high position. In positions deviating from the high position, such as the low position and intermediate positions, the actuator element is then for example out of engagement with the stop element. Also, the actuator element may come out of engagement with the stop element, and thereby the position of the actuator element relative to the housing changes when the at least one magnet device reaches or has reached the high position. In the positions deviating from the high position, such as the low position and the intermediate positions, the actuator element is then for example in engagement with the stop element. The actuator element may also be pretensioned in a specific position by a spring mechanism.

Also, the actuator element may be guided in or on the housing and arranged such that, when the at least one magnet device assumes the high position, it comes into engagement with the actuating element of the limit switch, if for example it has been out of engagement with the actuating element of the limit switch in the positions deviating from the high position, such as the low position and intermediate positions. Alternatively, when the at least one magnet device assumes the high position, the actuator element may also come out of engagement with the actuating element of the limit switch, if for example it has been in engagement with the actuating element of the limit switch in the positions deviating from the high position, such as the low position and intermediate positions.

The high-position detecting device or the magnetic track brake apparatus may also have an electronic controller which evaluates the switch state of the electrical limit switch and optionally also controls the at least one actuation cylinder. The electronic controller may then control the at least one actuation cylinder in particular depending on the high-position signal generated by the high-position detecting device.

To summarize, the following advantages are achieved: by accommodating the high-position detector or high-position detecting module on or in the actuation cylinder, a standard position is achieved for position monitoring, and an independence of the bogie installation spaces. Because of the definition of a standard position, project-specific fitting of the magnetic track brake in the bogie is easier and the adaptation complexity reduced. Since no dedicated interface to the bogie is required because of the fastening on or in the actuation cylinder, the design of the bogie is simplified. The standardized position also allows uncomplicated retrofitting in existing bogies.

FIG. 1 shows a perspective illustration of a magnetic track brake apparatus according to a disclosed embodiment. The magnetic track brake apparatus 1 has a frame-like structure with two magnet devices 2, which are arranged in the region of the rails and here for example designed as articulated magnets, and which are connected via two transversely arranged tie bars 3 into a brake frame 4. In particular, the brake frame 4 comprises two magnet devices 2 which are connected together by two tie bars 3 arranged transversely relative to the two magnet devices 2 and with parallel spacing from one another. The two tie bars 2 hold the two magnet devices 2 at the track gauge of the rails. Instead of articulated magnets, the magnet devices 2 may also be configured as rigid magnets.

The articulated magnets 2 have a plurality of links, each configured as horseshoe magnets to which an excitation coil is assigned. The legs of the horseshoe magnets point in the direction towards the rails, so that the open part of each magnet is magnetically short-circuited when the magnet devices 2 are lowered onto the rails. The individual links of the articulated magnets are arranged one behind the other in the rail longitudinal direction, so they extend in the rail longitudinal direction. To reduce wear and optimize frictional resistance, sliding shoes are arranged on the end portions of the articulated magnets 2 pointing towards the rails. For lowering and return, here for example two actuation cylinders 5 are assigned to each articulated magnet 2 and are attached to a bogie (not shown here) via a first flange 6; the actuating pistons 7 thereof on piston rods 8 carry a second flange (not shown here) which acts for example on the assigned tie bar 3. Alternatively, the second flange could also be connected to a magnet device 2. The first flange 6 is configured such that it allows a relative twist between the bogie and the respective actuation cylinder 5.

The brake frame 4 with the two tie bars 3 and the two articulated magnets 2, together with the four actuation cylinders 5, form a magnetic track brake unit 9 which is then fixed to the bogie via the actuation cylinders 5 and can be lowered vertically onto the rails into a low position, in which the magnet devices 2 or the sliding shoes of the articulated magnets 2 make contact with the rails in order to generate a magnetic attraction force between the rail and the magnet devices 2 by a magnetic short-circuit with the rail. Secondly, the magnetic track brake unit 9 can be lifted vertically away from the rail by the actuation cylinders 5 into a high position and into any intermediate positions between the low position and the high position.

Figure 5:
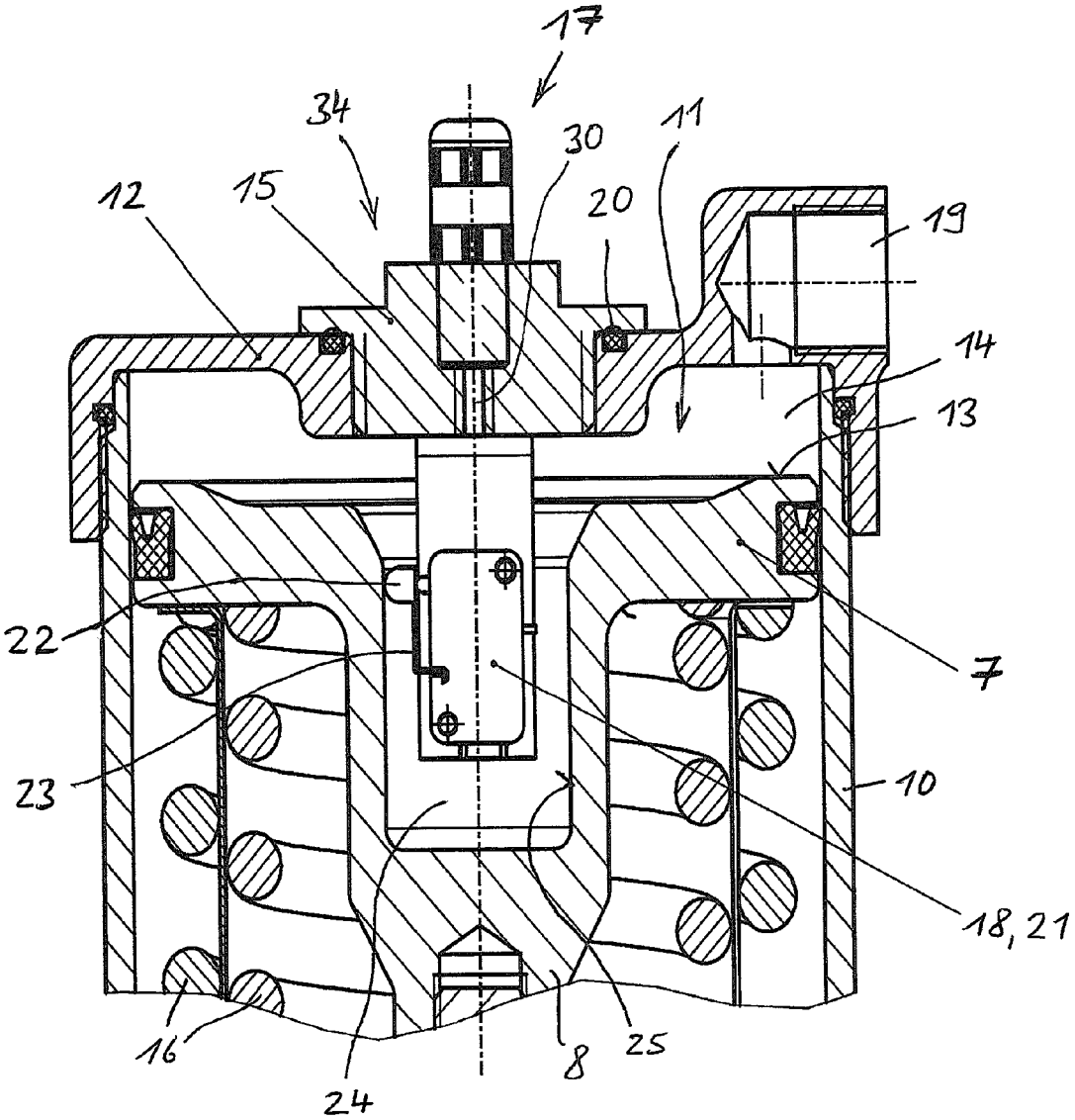
FIG. 5 shows a sectional illustration of an actuation cylinder of a magnetic track brake apparatus in a high position, with a high-position detecting module according to a disclosed embodiment.

The actuation cylinders 5 of the magnetic track brake unit 9 are here connected for example to a pressure-medium circuit. As FIG. 5 shows, the actuation cylinders 5 each comprise a cylinder housing 10 and an actuating piston 7 which is movable relative to the cylinder housing 5.

Between a cover 12 closing a cylinder opening 11 of the cylinder housing 10, a radially inner circumferential face of the cylinder housing 10 and an end face 13 of the actuating piston 7, a working chamber 14 of the actuation cylinder 5 is formed which can be loaded with pressure medium and relieved of pressure medium via a pressure connection 19. Consequently, the actuating piston 7 is actuated depending on the pressure of the pressure medium in the working chamber 14. The actuating piston 7 has a piston rod 8 which at the end carries the second flange, which is here connected for example to the assigned tie bar 3. The actuating piston 7 is pretensioned by a spring mechanism 16 resting on the base of the actuation cylinder 5, which is not visible in FIG. 5. When the piston rod 8 is extended out of the actuation cylinder 5, the magnetic track brake unit 9 assumes the low position, and when the piston rod 8 is retracted into the actuation cylinder 5, it assumes the high position shown in FIG. 1.

By corresponding control of the pressure-medium circuit, the actuating pistons 7 or their piston rods 8 can be retracted into and extended from the actuation cylinders 5, so that when in the low position, hence in contact with the rail, the magnetic track brake unit 9 can be raised into the high position, i.e. furthest away from the rails, or into any intermediate positions between the low position and the high position. To move back for example to the high position, the pressure in the working chambers 14 of the actuation cylinders 5 is reduced, for example by connecting the working chambers 14 to a pressure-medium store into which pressure medium flows.

The brake force applied via the magnetic track brake unit 9 is transmitted to the bogie via carriers (not shown here) which act on stops arranged on the bogies. To center the magnetic track brake unit 9 in its unactuated high position, centering devices may be provided thereon which can be brought into engagement with corresponding counterpieces of the bogie.

The magnetic track brake apparatus 1 also has a high-position detecting device 17 which generates a high-position signal when the magnetic track brake unit 9 or the two magnet devices 2 assume the high position. The high-position signal, i.e. the signal which indicates that the magnetic track brake unit 9 has reached the high position, is evaluated for example in an electronic controller (not shown here) which here for example also controls the actuation cylinders 5.

As FIG. 5 shows, the high-position detecting device 17 may have an electrical limit switch 18 which is arranged for example inside only one actuation cylinder 5 of the four actuation cylinders 5 here and is configured as a microswitch for example, and which for example has two switch states and changes the switch state when the magnetic track brake unit 9 or the two magnet devices 2 assume the high position. The electrical limit switch 18 is integrated via an electrical connection for example in an electrical circuit, so that a change in switch state of the limit switch 18 causes a change of a signal level of the electrical circuit which can then be evaluated by the electronic controller. Depending on the change of switch state of the limit switch 18, the electronic controller then generates the high position signal or interprets the change of switch state of the limit switch 18 as a high-position signal.

Optionally, the electrical limit switch 18 is formed and arranged in the actuation cylinder such that, when the magnetic track brake unit 9 or magnet devices 2 is/are in the high position, it can be actuated directly for example by the actuating piston 7 of the actuation cylinder 5 concerned and thereby changes its switch state.

The high-position detecting device 17 has a structural unit 15 which contains the limit switch 18 and is releasably mounted in a central cover opening 34 of a cover 12. The cover 12 tightly closes a cylinder opening 11 of the actuation cylinder 5 pointing towards the first flange 6.

In the installation position of the structural unit 15 on or in the cover 12, the limit switch 18 is then arranged such that it protrudes into the interior of the actuation cylinder 5 concerned and is then arranged in the working chamber 14 between the cover 12 and the end face 13 of the actuating piston 7.

Here, as shown in FIG. 5, the limit switch 18—together with a connecting cable 30 which is connected to the limit switch 18 and routed through the cover opening 34, for transmitting the signals of the limit switch 18 to an electronic controller for evaluation—may form a structural unit 15 which is releasably mounted on or in the cover 12 of the actuation cylinder 5 as a high-position detecting module. The structural unit 15 is here for example tightly mounted in the cover opening 34 of the cover 12 with interposition of a seal 20.

The structural unit 15 then constitutes a high-position detecting module which can easily be mounted on the actuation cylinder 5, namely simply by insertion in the cover opening 34 of the cover 12, and easily removed by releasing the cover 12. The limit switch 18 is here arranged in the sealed working chamber 14 of the actuation cylinder 5 and thereby protected from environmental influences.

The limit switch 18 has for example a cuboid switch housing 21 and an actuating element 22 which, viewed in the usage position, is arranged laterally on the outside of the switch housing 21 and can be moved into a retracted and extended position, wherein on movement of the actuating element between the extended position and the retracted position, the switch state of the limit switch 18 changes. In particular, the actuating element 22 is arranged at one end of a lever 23 which at its other end is rotatably mounted on a switch mechanism in the switch housing 21, so that a sideways actuation of the actuating element 22 in FIG. 5 places this into the retracted position and hence provokes a rotational movement of the lever 23, which in turn changes the switch state of the limit switch 18. The actuating element 22 or the lever 23 may be pretensioned for example by spring mechanism into the extended position.

Furthermore, the actuating piston 7 has, for example in its end face 13, a central recess 24 pointing towards the cover 12 with a radially inner circumferential face 25, wherein the actuating element 22 of the limit switch 18 and the recess 24 in the actuating piston are arranged and cooperate such that, when the magnetic track brake unit 9 or magnet devices 2 is/are in an intermediate position deviating from high position, or in the low position, the actuating piston 7 or its piston rod 8 is extended and the limit switch 18 or its actuating element 22 is then outside the recess, whereby the spring-loaded actuating element 22 of the limit switch 18 assumes the laterally extended position. When however the magnetic track brake unit 9 or magnet devices 2 reaches/reach or has/have reached the high position, the limit switch 18 or the actuating element 22 is inserted at least axially into the recess 24, whereby the actuating element 22 contacts the radially inner circumferential face 25 of the recess 24 and, because of the insertion and contact, is forced into the retracted position, as shown in FIG. 5. On insertion of the actuating element 22 into the recess 24, it is useful if the recess 24 widens in the manner of a hopper at its edge. In the example described here, therefore the actuating direction of the actuating element 22 is approximately perpendicular to the movement direction of the actuating piston 7 of the actuation cylinder 5.

Since the magnetic track brake unit 9 is excited into vertical oscillations during use, and therefore moves within a certain vertical travel range even when it has assumed the high position, the axial depth of the recess 24 of the actuating piston 7 serves as an axial tolerance range for a tolerated vertical travel range of the magnetic track brake unit 9 in the high position, in which the actuating element 22 of the limit switch assumes its retracted position, so that then no change in the switch state of the limit switch 18 can take place.

The integration of the high-position detecting device 17, configured as a high-position detecting module, in at least one actuation cylinder 5 of the four actuation cylinders, allows it to be attached to the cover 12 of the actuation cylinder 5, wherein the cover 12 then forms a component of the high-position detecting module or high-position detecting device 17. Because of the simple mounting method, the high-position detecting device 17 can quickly be removed from the magnetic track brake apparatus 1 integrated in the bogie. Thus repairs, service and maintenance are substantially facilitated. Because of the position of the high-position detecting device 17 inside at least one of the actuation cylinders 5, protected from environmental influences, no additional seals of the high-position detecting device 17 are required.

According to a further embodiment shown in FIG. 1 to FIG. 4, the high-position detecting device 17 may be configured as a separate structural unit with respect to the actuation cylinder or cylinders 5 with which it cooperates, and is releasably attached to the outside of the cylinder housing 10, here for example of just one actuation cylinder 5, by a fastening device 26.

The high-position detecting device 17 here optionally also comprises an electrical limit switch 18 arranged inside a housing 27 of the structural unit, with two switch states, wherein the limit switch 18 is configured for example as the embodiment in FIG. 5 and has a cuboid switch housing 21 and the actuating element 22, which, viewed in the usage position, is arranged laterally on the outside of the switch housing 21 and can be moved into an extended and a retracted position, and is attached to one end of the lever 23. As in the embodiment described above, on a movement of the actuating element 22 between the extended position and the retracted position, the switch state of the limit switch 18 changes.

Figure 2:
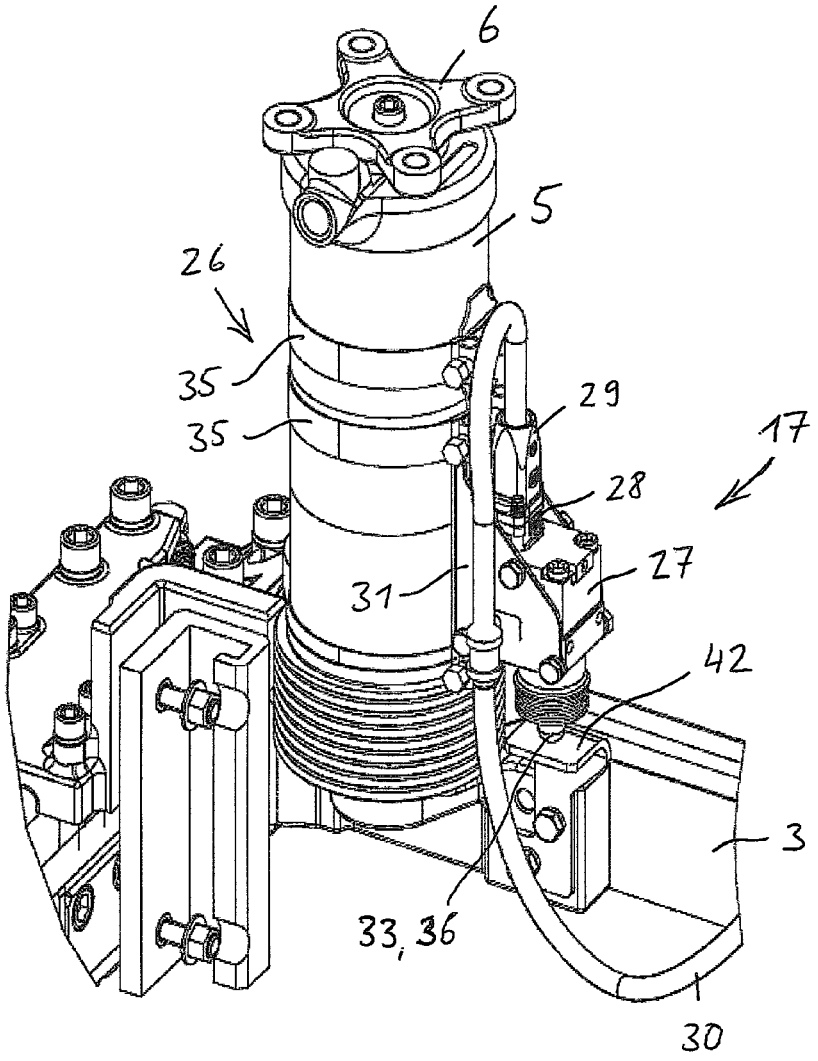
FIG. 2 shows an extract from FIG. 1 with an actuation cylinder of a magnetic track brake apparatus and a high-position detecting module which is directly and releasably attached to the actuation cylinder.

As FIG. 2 shows, the high-position detecting device 17 has on its housing 27 a plug contact 28 which is connected inside the housing 27 to the limit switch 18, and which is connected to a complementary plug contact 29 connected to a connecting cable 30, which is itself routed to the electronic controller which evaluates a change in switch state of the limit switch 18 as a high-position signal.

Figure 3:
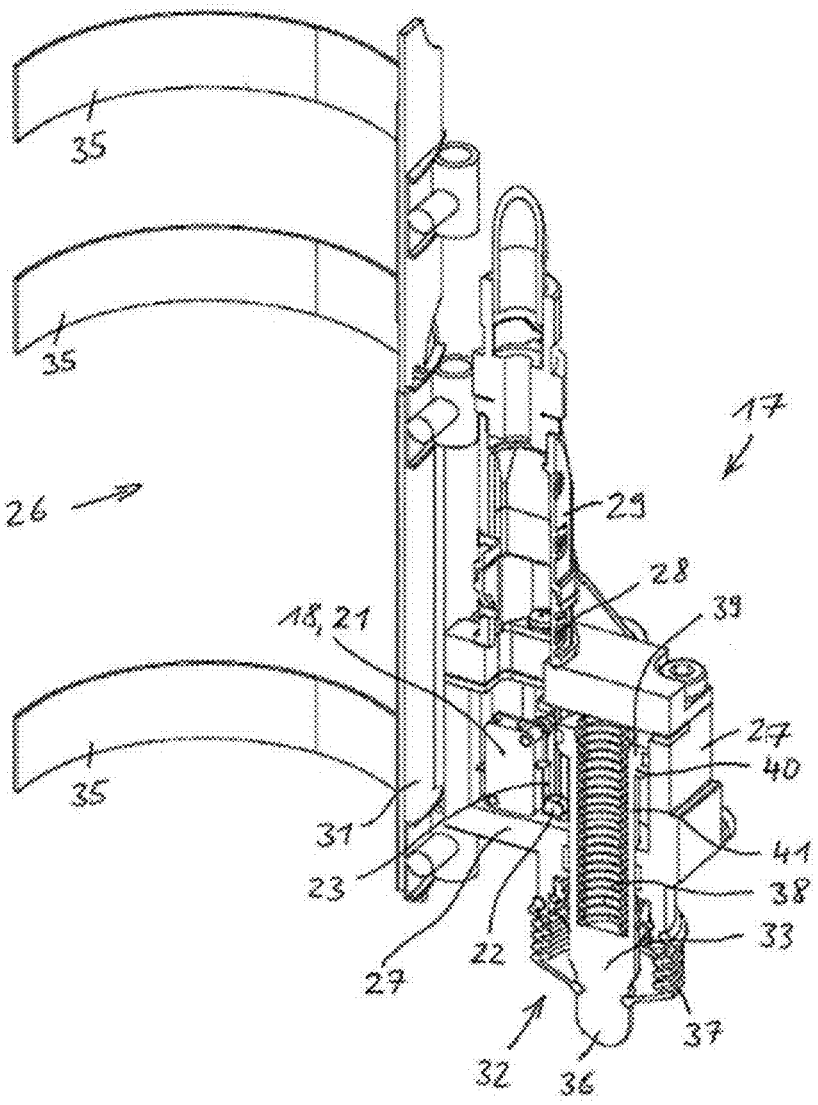
FIG. 3 shows only the high-position detecting module from FIG. 2 in the high position.
Figure 4:
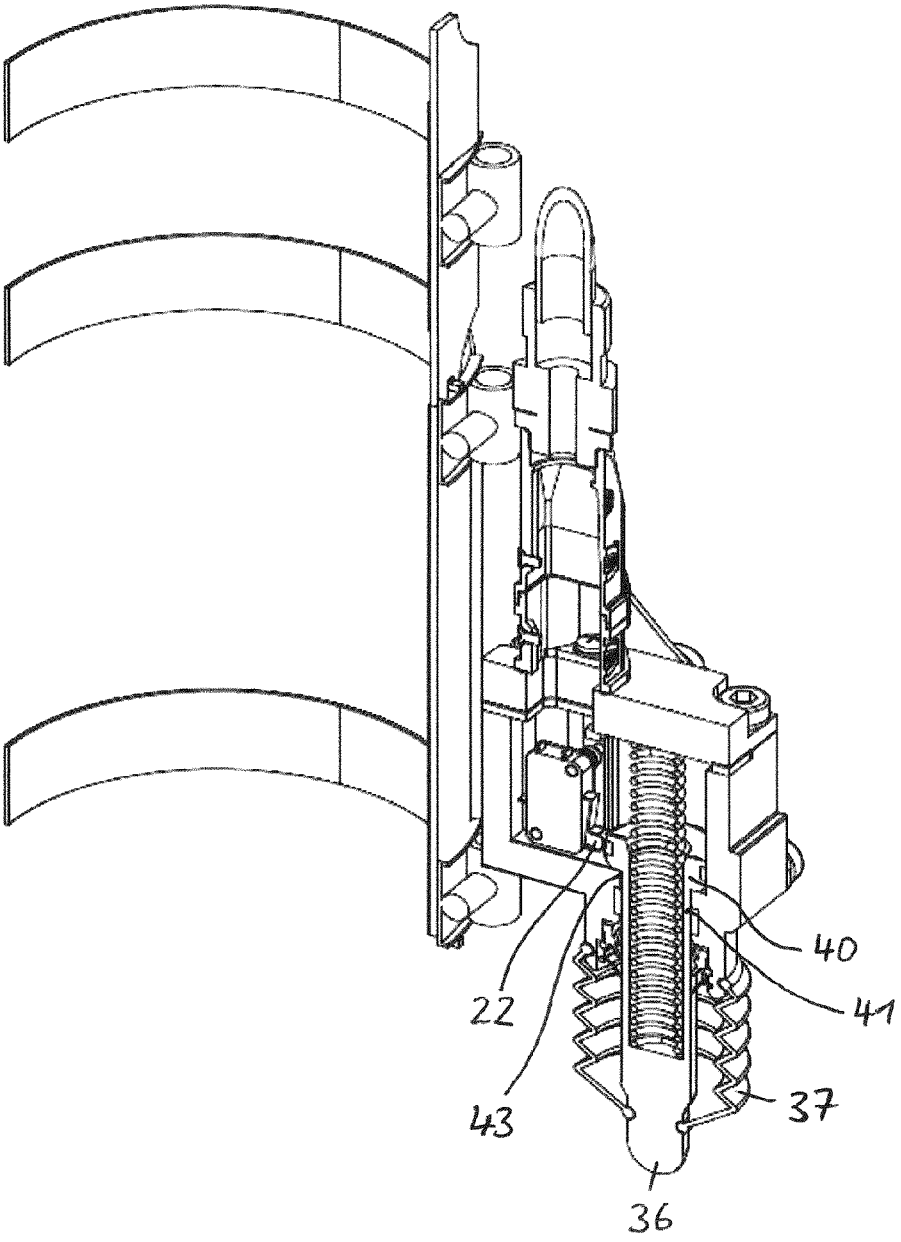
FIG. 4 shows only the high-position detecting module from FIG. 2 in a position deviating from the high position.

The housing 27 of the high-position detecting device 17—here configured as a separate structural unit—has a fastening bracket 31 and an actuator element 33 which protrudes from the housing opening 32 of the housing 27 and is movably guided in the housing 27, as illustrated in particular in FIG. 3 and FIG. 4.

The fastening bracket 31 has an outer contact face which, in mounted state of the high-position detecting device 17, contacts a complementarily shaped outer face of the actuation cylinder 5. In the present case, the two outer faces for example form partial cylinder faces or cylinder sector faces with substantially identical radius, and thus achieve a degree of centering of the high-position detecting device 17 on the actuation cylinder 5 when the high-position detecting device 17 is clamped together with the actuation cylinder 5, as can easily be imagined from FIG. 2 to FIG. 4.

The high-position detecting device 17, configured as a structural unit, is exclusively and directly attached via the fastening bracket 31 to the actuation cylinder 5 or to the outer face of the cylinder housing 10 by a releasable fastening device 26. Thus the high-position detecting device 17 can be retrofitted to any actuation cylinder 5 for example. Optionally, the fastening device 26 comprises two clamping straps 35 which are attached to the fastening bracket 31 of the housing 27 and, viewed in the circumferential direction, at least partially clamp around the cylinder housing 10, wherein the clamping force can be adjusted in particular by clamping screws. Consequently, the high-position detecting device 17 is optionally held by friction on the cylinder housing 10 by the clamping force of the clamping straps 35 and thereby can easily be fitted and removed. The high-position detecting device 17 here again constitutes a high-position detecting module which can easily be mounted simply by releasable attachment to the outside of any actuation cylinder 5 by tightening the fastening device 26, and be removed from the actuation cylinder 5 concerned by releasing the fastening device 26.

The actuator element 33 is in particular a cylindrical body which, when the high-position detecting device 17 is mounted on the actuation cylinder 5, is arranged or can be actuated e.g., parallel to a center axis of the actuation cylinder 5, the actuating piston 7 or the piston rod 8. The actuator element 33 can in particular be axially actuated between an extended position and a retracted position, wherein a first end 36 of the actuator element 33 still protrudes from the housing opening 32 of the housing 27 in both positions. Sealing mechanism—here for example an elastic bellows 37 attached on one side to the first end 36 of the actuator element 33 and on the other side to the edge of the housing opening 32—seal the interior of the high-position detecting device 17 from the environment. Accordingly, the limit switch 18 is tightly arranged completely inside the housing 27 of the high-position detecting device 17.

Particularly, optionally, the actuator element 33 is spring-loaded into the extended position by pressure spring mechanism 38 which rest on one side in a central blind hole of the actuator element 33 and on the other side on the housing 27. Furthermore, a second end 39 of the actuator element 33 arranged inside the housing 27 has an e.g., circumferential collar 40, via which it can actuate the actuating element 22 of the limit switch 18 from the extended position into the retracted position, in the manner to be described in more detail below. A shaft portion 41 of the actuator element adjoining the second end 39 has a smaller diameter than the collar 40.

The high-position detecting device 17 is held as a structural unit on the actuation cylinder 5 by the fastening device 26 such that the first end 36 of the actuator element 33, which is pretensioned by the pressure spring mechanism 38 into the extended position, protrudes through the housing opening 32 and can be contacted here for example by a stop element 42 arranged on the assigned tie bar 3 and here for example formed as a pressure plate, in particular directly when the magnetic track brake unit 9 or magnet devices 2 assumes/assume the high position. By this contact, which here optionally occurs or is present in the high position of the magnetic track brake unit 9 or magnet devices 2, the actuator element 33 is actuated against the effect of the pressure spring mechanism 38 into the retracted position shown in FIG. 3, in which the actuating element 22 of the limit switch 18 lies opposite the shaft portion 41 of the actuator element 33 with radial play and cannot therefore be actuated thereby. Furthermore, then also the collar 40 of the actuator element 33 is axially spaced from the actuating element 22 of the limit switch 18 and cannot actuate this.

As already explained in relation to the exemplary embodiment of FIG. 5, the magnetic track brake unit 9 is excited into vertical oscillations during use, and therefore moves within a certain vertical travel range even when the high position is assumed. Therefore, the shaft portion 41 of the actuator element 33, with smaller diameter than the collar 40, here serves for example as an axial tolerance range for a tolerated vertical travel range of the magnetic track brake unit 9 in the high position (in which the actuating element 22 of the limit switch 18 can assume its extended position), because inside the shaft portion 41 of the actuator element 33, the actuating element 22 of the limit switch 18 lies opposite the shaft portion 41 of the actuator element 33 with play and does not contact this, so that in the axial region of the shaft portion 41 which constitutes the tolerated vertical travel range in the high position, no change of switch state of the limit switch 18 can take place. In the switch state of the limit switch 18, which is then unchanged within the tolerated vertical range and in which here for example the actuating element 22 of the limit switch 18 assumes the extended position, according to FIG. 3 the latter signals the high position of the magnetic track brake unit to the electronic controller as a high-position signal.

If then, by corresponding activation of the actuation cylinder 5, the actuating pistons 7 are extended from the actuation cylinders 5 so that the magnetic track brake unit 9 is moved starting from the high position into intermediate positions and finally into the low position, the actuator element 33 moves down under the action of the pressure spring mechanism 38 in FIG. 3, wherein the actuating element 22 is initially still not actuated by the radially spaced shaft portion 41 until the collar 40 at the second end 39 of the actuator element 33 reaches the vertical level of the actuating element 22 of the limit switch 18.

If then, during further downward movement of the magnetic track brake unit 9 at the end of the tolerated vertical travel range, the first end 36 of the actuator element 33 comes out of engagement with the stop element 42 on the tie rod 3, at the other end the contact of the collar 40 with the actuating element 22 of the limit switch 18 is created, as shown in FIG. 4, whereby the latter is forced into the retracted position and thereby the limit switch 18 changes its switch state and hence signals the leaving of the high position, because the high-position signal is then no longer generated.

In positions deviating from the high position, such as the intermediate positions and low position of the magnetic track brake unit 9, accordingly optionally there is no contact between the first end 36 of the actuator element 33 and the stop element 42 on the tie bar 3, wherein then however the collar 40 at the second end 39, because of the pressure forces of the pressure spring mechanism 38, stops against an inner stop 43 on the housing 27, and the first end 36 of the actuator element 33 is then in its maximally extended position.

On return of the magnetic track brake unit 9 from the low position to the high position, the above-described steps are performed in reverse order, i.e. in the low position as the starting position, the first end 36 of the actuator element is out of engagement with the stop element 42 on the tie bar 3, and the collar 40 of the actuator element 33 is in contact with the actuating element 22 of the limit switch 18, as shown in FIG. 4. Then the actuating element 22 of the limit switch 18 is forced by the collar into its retracted position against the action of the spring forces, and thereby signals a position of the magnetic track brake unit 9 deviating from the high position.

If the magnetic track brake unit 9 is placed in the high position by the actuation cylinders, then—optionally only on reaching the high position—the first end 36 of the actuator element 33 comes into engagement with the stop element 42 on the tie bar 3. The resulting shift of the actuator element 33 against the effect of the pressure spring mechanism 38 causes the collar 40 of the actuator element 33 to come out of engagement with the actuating element 22 of the limit switch 18, whereby—because of the spring—this is forced into its extended position, in which however it cannot contact the shaft portion 41 of the actuator element 33, whereby the limit switch 18 changes its switch position and thereby the high-position signal is generated.

LIST OF REFERENCE SIGNS

1 Magnetic track brake apparatus
2 Magnet devices/articulated magnets
3 Tie bars
4 Brake frame
5 Actuation cylinder
6 First flange
7 Actuating piston
8 Piston rod
9 Magnetic track brake unit
10 Cylinder housing
11 Cylinder opening
12 Cover
13 End face
14 Working chamber
15 Structural unit
16 Spring mechanism
17 High-position detecting device
18 Limit switch
19 Pressure connection
20 Seal
21 Switch housing
22 Actuating element
23 Lever
24 Recess
25 Radially inner circumferential face
26 Fastening device
27 Housing
28 Plug contact
29 Complementary plug contact
30 Connecting cable
31 Fastening bracket
32 Housing opening
33 Actuator element
34 Cover opening
35 Clamping straps
36 First end
37 Seal/bellows
38 Pressure spring mechanism
39 Second end
40 Collar
41 Shaft portion
42 Stop element
43 Inner stop

The invention claimed is:

1. A magnetic track brake apparatus for a rail vehicle, the apparatus comprising:

at least one pressure-medium-actuated actuation cylinder which has a cylinder housing and an actuating piston movable relative to the cylinder housing;

at least one magnet device configured to be lowered into a low position onto a rail by the at least one actuation cylinder to generate a magnetic attraction force between the rail and the at least one magnet device by a magnetic short-circuit with the rail, and which can be placed, by the actuation cylinder, into a high position raised from the rail and into any intermediate positions between the low position and the high position; and at least one high-position detecting device which generates a high-position signal when the at least one magnet device assumes the high position, wherein the high-position detecting device comprises at least one electrical limit switch which is arranged inside the actuation cylinder, has at least two switch states and changes the switch state when the magnet device assumes the high position.

2. The magnetic track brake apparatus of claim 1, wherein, in the high position, the at least one electrical limit switch is actuated directly or indirectly by the actuating piston.

3. The magnetic track brake apparatus of claim 2, wherein the high-position detecting device comprises a structural unit which contains the at least one limit switch, is releasably attached to or in a cover of the cylinder housing of the actuation cylinder and is arranged such that the at least one limit switch protrudes into a working chamber of the actuation cylinder.

4. The magnetic track brake apparatus of claim 3, wherein the structural unit is arranged tightly on or in the cover of the actuation cylinder.

5. The magnetic track brake apparatus of claim 3, wherein the limit switch has a switch housing and an actuating element which, viewed in the usage position, is arranged on the outside of the switch housing and can be moved into an extended and a retracted position, wherein on movement of the actuating element between the extended position and the retracted position, the switch state of the limit switch changes, the actuating piston has a central recess pointing towards the working chamber with a radially inner circumferential face, and the actuating element of the limit switch and the recess in the actuating piston are arranged and cooperate such that:

when the magnet device is in an intermediate position deviating from the high position, or in the low position, the actuating element of the limit switch is out of engagement with the radially inner circumferential face of the recess and then assumes the extended position, and when the magnet device is in the high position or has reached this, the actuating element of the limit switch is in or comes into engagement with the radially inner circumferential face of the recess and is then pushed into the retracted position because of the contact.

6. The magnetic track brake apparatus of claim 5, wherein the actuating element of the limit switch is spring-pretensioned into the extended position.

7. The magnetic track brake apparatus claim 1, wherein the high-position detecting device has an electronic controller which evaluates the switch state of the at least one electrical limit switch.

8. A rail vehicle with at least one magnetic rail brake apparatus of claim 1.

9. A magnetic track brake apparatus for a rail vehicle, the apparatus comprising:

at least one pressure-medium-actuated actuation cylinder which has a cylinder housing and an actuating piston movable relative to the cylinder housing;

at least one magnet device which can be lowered into a low position onto a rail by the at least one actuation cylinder to generate a magnetic attraction force between the rail and the at least one magnet device by a magnetic short-circuit with the rail, and which can be placed, by the actuation cylinder, into a high position raised from the rail and into any intermediate positions between the low position and the high position; and at least one high-position detecting device which generates a high-position signal when the at least one magnet device assumes the high position, wherein the high-position detecting device has a structural unit which is separate from the at least one actuation cylinder and is releasably attached to the cylinder housing of the at least one actuation cylinder by a fastening device, and at least one electrical limit switch which is arranged inside a housing of the high-position detecting device and has least two switch states, wherein the limit switch has an actuating element which can be placed into at least two different positions and, on movement of the actuating element between the at least two different positions, the switch state of the limit switch changes between the at least two switch states, and wherein the structural unit has at least one actuator element which is movable on or in the housing such that the actuator element changes its position relative to the housing depending on the vertical position of the at least one magnet device, and hence exerts an influence on the position of the actuating element of the limit switch.

10. The magnetic track brake apparatus claim 9, wherein the fastening device comprises at least one clamping strap which is attached to the housing of the structural unit and which, viewed in the circumferential direction, at least partly clamps around the cylinder housing of the at least one actuation cylinder.

11. The magnetic track brake apparatus of claim 9, wherein the structural unit constitutes a structural unit which can be retrofitted to the at least one actuation cylinder.

12. The magnetic track brake apparatus of claim 9, further comprising a brake frame which has at least two magnet devices and two tie bars connecting the magnet devices transversely together, wherein the at least one actuation cylinder is attached on one side to the brake frame and on the side to a bogie.

13. The magnetic track brake apparatus of claim 12, wherein the brake frame has a stop element and the structural unit is arranged on the at least one actuation cylinder such that:

the actuator element stops against the stop element and thereby the position of the actuator element relative to the housing changes when the at least one magnet device reaches or has reached the high position, and the actuator element comes out of engagement with the stop element and thereby the position of the actuator element relative to the housing changes when the at least one magnet device reaches or has reached the high position.

14. The magnetic track brake apparatus claim 9, wherein the actuator element is guided in on the housing and arranged such that:

when the at least one magnet device assumes the high position, it comes into engagement with the actuating element of the limit switch, or when the at least one magnet device assumes the high position, it comes out of engagement with the actuating element of the limit switch.

15. The magnetic track brake apparatus of claim 9, wherein the high-position detecting device has an electronic controller which evaluates the switch state of the at least one electrical limit switch.

16. A rail vehicle with at least one magnetic rail brake apparatus of claim 9.

* * * * *